United States Patent [19]

Henzel et al.

[11] Patent Number: 4,853,367

[45] Date of Patent: Aug. 1, 1989

[54] PARTICULATE POLYPROPYLENE WAXES FOR DYE-DONOR ELEMENT USED IN THERMAL DYE TRANSFER

[75] Inventors: Richard P. Henzel, Webster; Noel R. Vanier, Rochester; George B. Bodem, Pittsford, all of N.Y.

[73] Assignee: Eastman Kodak Company, Rochester, N.Y.

[21] Appl. No.: 309,743

[22] Filed: Feb. 10, 1989

Related U.S. Application Data

[63] Continuation-in-part of Ser. No. 173,346, Mar. 25, 1988, abandoned.

[51] Int. Cl.[4] ..... B41M 5/035; B41M 5/26

[52] U.S. Cl. ..... 503/227; 8/471; 428/195; 428/323; 428/340; 428/480; 428/481; 428/484; 428/913; 428/914

[58] Field of Search ..... 8/471; 428/195, 323, 428/480, 340, 481, 484, 488.1, 532, 913, 914; 503/227

[56] References Cited

U.S. PATENT DOCUMENTS

| | | | |
|---|---|---|---|
| 4,559,273 | 12/1985 | Kutsukake et al. | 8/471 |
| 4,700,207 | 10/1987 | Vanier et al. | 503/227 |
| 4,778,729 | 10/1988 | Mizobuchi | 428/484 |

FOREIGN PATENT DOCUMENTS

| | | | |
|---|---|---|---|
| 210838 | 2/1987 | European Pat. Off. | 503/227 |
| 0106997 | 6/1984 | Japan | 503/227 |
| 1121994 | 6/1986 | Japan | 503/227 |

*Primary Examiner*—Bruce H. Hess
*Attorney, Agent, or Firm*—Harold E. Cole

[57] ABSTRACT

A dye-donor element for thermal dye transfer comprising a support having thereon a dye layer comprising a dye dispersed in a polymeric binder, the dye layer also containing at least one particulate polypropylene wax having an average particle size less than about 30 μm and having a melting point above about 125° C. Use of the particulate wax minimizes various printing defects without reducing gloss.

18 Claims, No Drawings

PARTICULATE POLYPROPYLENE WAXES FOR DYE-DONOR ELEMENT USED IN THERMAL DYE TRANSFER

This invention relates to dye-donor elements used in thermal dye transfer, and more particularly to the use of a particulate polypropylene wax in the dye layer to minimize various printing defects without reducing gloss.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4, 1986, the disclosure of which is hereby incorporated by reference.

Printing defects are often obtained during thermal dye transfer printing. Small unprinted areas in the receiver are sometimes obtained which are called "mottle". "Wave defects" are sometimes obtained in the receiver which look like ripples in water from a forward-moving boat. Wave defects are caused by non-uniform motion of the dye-donor through the nip formed by the dye-receiver and the thermal printing head. Occasionally, dyes crystallize in the dye-donor, causing loss of image discrimination in low density areas and decreased maximum density. It would be desirable to eliminate or reduce these print defects.

European Patent Application No. 210,838 relates to the use of lubricating particles in a dye layer of a dye-donor element. A long list of lubricating particles are disclosed which include various silicone oils, polyoxyalkylene glycols, paraffin wax, polyethylene wax, fluorocarbon resins, solid particle lubricants, etc. Column 6 of U.S. Pat. No. 4,720,480 and JP No. 62/283,176 also disclose the use of various materials such as a polyethylene wax in the dye layer of a dye-donor element.

There is a problem with using many of these prior art materials in that they do not reduce or eliminate many of the print defects described above or do not have sufficient surface gloss, which is highly desirable in a reflection print, as will be shown by the comparative tests hereinafter.

It would be desirable to employ particles in a dye layer of a dye-donor element which eliminate or reduce print defects as described above and which would also provide sufficient surface gloss. These and other objects are achieved in accordance with this invention.

Accordingly, this invention relates to a dye-donor element for thermal dye transfer comprising a support having thereon a dye layer comprising a dye dispersed in a polymeric binder, and wherein the dye layer also contains at least one particulate polypropylene wax having an average particle size less than about 30μm and having a melting point above about 125° C.

The particulate polypropylene wax may be employed in the invention in any amount which is effective for the intended purpose. In general, good results have been obtained using an amount of from about 0.005 to about 0.2 g/m$^2$.

As used herein, the term wax is meant to describe a material that is a plastic solid at ambient temperature and which melts upon being subjected to moderately elevated temperature, and which in the liquid state has a viscosity under about 8000 cps.

Particulate polypropylene wax materials which can be used in the invention include the following materials:

Compound (1) micronized polypropylene particles, such as Micropro-400® from Micro Powders Inc., having a melting point of 140°-143° C.;

Compound (2) micronized polypropylene particles, such as Micropro-600® from Micro Powders Inc., having a melting point of 146°-149° C.;

Compound (3) micronized polypropylene particles, such as Non-Skid 5389® from Shamrock Technologies, Inc., having a melting point of 140°-155° C.; and Compound (4) polypropylene particles, such as Epolene N-15® from Eastman Chemical Products Inc., having a melting point of 163° C.

The dye in the dye-donor element of the invention is dispersed in a polymeric binder such as a cellulose derivative, e.g., cellulose acetate hydrogen phthalate, cellulose acetate, cellulose acetate propionate, cellulose acetate butyrate, cellulose triacetate or any of the materials described in U.S. Pat. No. 4,700,207 of Vanier and Lum; a polycarbonate; poly(styrene-co-acrylonitrile), a poly(sulfone) or a poly(phenylene oxide). The binder may be used at a coverage of from about 0.1 to about 5 g/m$^2$.

In a preferred embodiment of the invention, the dye binder is cellulose acetate butyrate or cellulose acetate propionate. The acetyl content may range from about 1.5 to about 31%, the propionyl content may range from about 38 to about 48%, and the butyryl content may range from about 15 to about 56%.

Any dye can be used in the dye layer of the dye-donor element of the invention provided it is transferable to the dye-receiving layer by the action of heat. Especially good results have been obtained with sublimable dyes. Examples of sublimable dyes include anthraquinone dyes, e.g., Sumikalon Violet RS® (product of Sumitomo Chemical Co., Ltd.), Dianix Fast Violet 3R-FS® (product of Mitsubishi Chemical Industries, Ltd.), and Kayalon Polyol Brilliant Blue N-BGM® and KST Black 146® (products of Nippon Kayaku Co., Ltd.), azo dyes such as Kayalon Polyol Brilliant Blue BM®, Kayalon Polyol Dark Blue 2BM®, and KST Black KR® (products of Nippon Kayaku Co., Ltd.), Sumickaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku co. Ltd.); acid dyes such as Kayanol Milling Cyanine 5R® (product of Nippon Kayaku Co.

Ltd.); basic dyes such as Sumicacryl Blue 6G ® (product of Sumitomo Chemical Co., Ltd.), and Aizen Malachite Green ® product of Hodogaya Chemical Co., Ltd.);

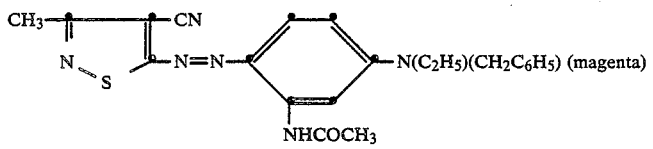

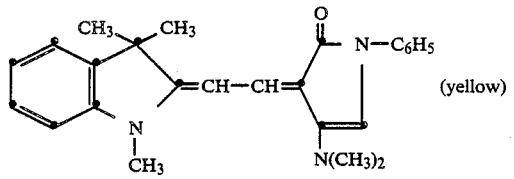

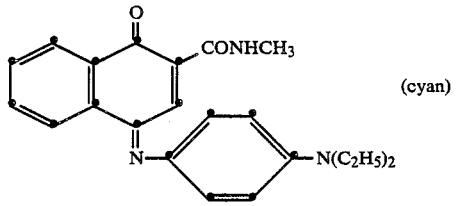

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

A dye-barrier layer may be employed in the dye-donor elements of the invention to improve the density of the transferred dye. Such dye-barrier layer materials include hydrophilic materials such as those described and claimed in U.S. Pat. No. 4,716,144 by Vanier, Lum and Bowman.

The dye layer of the dye-donor element may be coated on the support or printed thereon by a printing technique such as a gravure process.

Any material can be used as the support for the dye-donor element of the invention provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, olypropylene or methylpentane polymers; and polyimides such as polyimide-amides and polyetherimides. The support generally has a thickness of from about 2 to about 30 μm. It may also be coated with a subbing layer, if desired, such as those materials described in U.S. Pat. No. 4,695,288 of Ducharme or U.S. Pat. No. 4,737,486 of Henzel.

The reverse side of the dye-donor element may be coated with a slipping layer to prevent the printing head from sticking to the dye-donor element. Such a slipping layer would comprise a lubricating material such as a surface active agent, a liquid lubricant, a solid lubricant or mixtures thereof, with or without a polymeric binder. Preferred lubricating materials include oils or semi-crystaline organic solids that melt below 100° C. such as poly(vinyl stearate), beeswax, perfluorinated alkyl ester polyethers, poly(caprolactone), silicone oil, poly(tetrafluoroethylene), carbowax, poly(ethylene glycols), or any of those materials disclosed in U.S. Pat. Nos. 4,717,711 of Vanier, Harrison and Kan; 4,717,712 of Harrison, Vanier and Kan; 4,737,485 of Henzel, Lum and Vanier; and 4,738,950 of Vanier and Evans. Suitable polymeric binders for the slipping layer include poly(vinyl alcohol-co-butyral), poly(vinyl alcohol-co-acetal), poly(styrene), poly(vinyl acetate), cellulose acetate butyrate, cellulose acetate propionate, cellulose acetate or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.1 to 50 weight %, preferably 0.5 to 40, of the polymeric binder employed.

The dye-receiving element that is used with the dye-donor element of the invention usually comprises a support having thereon a dye image-receiving layer. The support may be a transparent film such as a poly(ether sulfone), a polyimide, a celulose ester such as cellulose acetate, a poly(vinyl alcohol-co-acetal) or a poly(ethylene terephthalate). The support for the dye-receiving element may also be reflective such as baryta-coated paper, polyethylene-coated paer, white polyester (polyester with white pigment incorporated therein), an ivory paper, a condenser paper or a synthetic paper such as duPont Tyvek ®.

The dye image-receiving layer may comprise, for example, a polycarbonate, a polyurethane, a polyester, polyvinyl chloride, poly(styrene-co-acrylonitrile), poly(caprolactone) or mixtures thereof. The dye image-receiving layer may be present in any amount which is effective for the intended purpose. In general, good results have been obtained at a concentration of from about 1 to about 5 g/m$^2$.

As noted above, the dye-donor elements of the invention are used to form a dye transfer image. Such a process comprises imagewise-heating a dye-donor element as described above and transferring a dye image to a dye-receiving element to form the dye transfer image.

The dye-donor element of the invention may be used in sheet form or in a continuous roll or ribbon. If a continuous roll or ribbon is employed, it may have only one dye or may have alternating areas of other different dyes, such as sublimable cyan and/or magenta and/or yellow and/or black or other dyes. Such dyes are disclosed in U.S. Pat. Nos. 4,541,830; 4,698,651 of Moore, Weaver and Lum; 4,695,287 of Evans and Lum; 4,701,439 of Weaver, Moore and Lum; 4,757,046 of Byers and Chapman; 4,743,582 of Evans and Weber; 4,769,360 of Evans and Weber; and 4,753,922 of Byers, Chapman and McManus, the disclosures of which are hereby incorporated by reference. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of yellow, cyan and magenta dye, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head (FTP-040 MCS001), a TDK Thermal Head F415 HH7-1089 or a Rohm Thermal Head KE 2008-F3.

A thermal dye transfer assemblage of the invention comprises (a) a dye-donor element as described above, and (b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following examples are provided to illustrate the invention.

EXAMPLE 1—PRINT DEFECTS

A cyan dye-donor element was prepared by coating on a 6 μm poly(ethylene terephthalate) support:

(1) a subbing layer of a titanium alkoxide (duPont Tyzor TBT ®) (0.12 g/m$^2$) from a n-propyl acetate and n-butyl alcohol solvent mixture, and (2) a dye layer containing the cyan dye illustrated above (0.28 g/m$^2$) and the particulate material indicated in Table 1 (0.08 g/m$^2$), in a cellulose acetate propionate (2.5% acetyl, 45% propionyl) binder (0.44 g/m$^2$) coated from a toluene, methanol and cyclopentanone solvent mixture. A slipping layer was coated on the back side of the element similar to that disclosed in U.S. application Ser. No. 062,797 of Henzel et al, filed June 16,1987 over a subbing layer of titanium alkoxide (duPont Tyzor TBT ®) (0.12 g/m$^2$) coated from a n-propyl acetate and n-butyl alcohol solvent mixture.

A dye-receiving element was prepared by coating the following layer on a titanium dioxide-pigmented poly(ethylene terephthalate) support which was subbed with a layer of poly(acrylonitrile-co-vinylidene chloride-co-acrylic acid) (14:79:7 wt. ratio):

Dye-receiving layer of Makrolon 5705 ® (Bayer AG Corporation) polycarbonate resin (2.9 g/m$^2$), 1,4-didecoxy-2,6-dimethoxyphenol (0.38 g/m$^2$); FC-431 ® surfactant (3M Corp.) (0.016 g/m$^2$) and DC-510 ® Surfactant (Dow Corning) (0.011 g/m$^2$) coated from methylene chloride.

A dye side of the dye-donor element strip approximately 10 cm × 13 cm in area was placed in contact with the dye image-receiving layer of the dye-receiver element of the same area. The assemblage was clamped to a stepper-motor driven 60 mm diameter rubber roller and a TDK Thermal Head (No. L-231) (thermostatted at 26° C.) was pressed with a force of 8.0 pounds (3.6 kg) against the dye-donor element side of the assemblage pushing it against the rubber roller.

The imaging electronics were activated causing the donor/receiver assemblage to be drawn between the printing head and roller at 6.9 mm/sec. Coincidentally, the resistive elements in the thermal print head were pulsed for 29 μsec/pulse at 128 μsec intervals during the 33 msec/dot printing time. A stepped density image was generated by incrementally increasing the number of pulses/dot from 0 to 255. The voltage supplied to the print head was approximately 23.5 volts, resulting in an instantaneous peak power of 1.3 watts/dot and a maximum total energy of 9.6 mjoules/dot.

The dye-receiving element was separated from the dye-donor element and was examined for unprinted areas. The following categories were established:

0-No unprinted areas
1-Slight number of unprinted areas
2-Moderate number of unprinted areas
3-Extensive number of unprinted areas The following results were obtained:

TABLE 1

| Particles in Dye Layer | Unprinted Areas |
|---|---|
| None (control) | * |
| Control Compd. 1 (PTFE) | 2 |
| Control Compd. 2 (silica) | 3 |
| Control Compd. 3 (silica) | 3 |
| Control Compd. 4 (silica) | 3 |
| Control Compd. 5 (silica) | 2 |
| Control Compd. 6 (PE) | 1 |
| Control Compd. 7 (PE) | 1 |
| Compd. 3 (invention) | 1 |

*There were extensive wave defects and it was difficult to separate the dye-donor from the dye-receiver.

Control Compound 1

DLX-6000 ® polytetrafluoroethylene micropowder (duPont) having a particle size of <1 μm.

Control Compound 2

Zeo 49 ® (J. M. Huber Co.) precipitated amorphous silica having an average particle size of 9 μm.

Control Compound 3

Zeofree 153 ® (J. M. Huber Co.) precipitated amorphous silican having an average particle size of 7 μm.

Control Compound 4

Zeosyl 200 ® (J. M. Huber Co.) precipitated amorphous silican having an average particle size of 5 μm.

Control Compound 5

Zeothix 177 ® (J. M. Huber Co.) precipitated amorphous silica having an average particle size of 1.5 μm.

Control Compound 6

Microfine M8-F ® (Astor Wax Co.) polyethylene wax having a melting point of 104°-110° C. This material is disclosed in Example 1 of JP No. 62/283,176.

Control Compound 7

MPP620XF ® polyethylene wax (Micro Powders Inc.) having a melting point of 114°-116° C.

The above results indicate that the addition of a particulate polyethylene or polypropylene wax to the dye layer substantially reduced unprinted areas in comparison to other particulate materials of the prior art. However, there are other problems with the use of polyethylene wax, as will be shown by Example 3.

EXAMPLE 2—PRINT DEFECTS

Cyan dye-donors (C) were prepared as in Example 1 except that they contained the particulate materials in the amounts indicated in Table 2. Additional control yellow dye-donors (Y) were also prepared as described in Example 1, except that the subbing layer for the dye layer was present at 0.16 g/m$^2$, the yellow dye illustrated above the (0.16 g/m$^2$) was used instead of a cyan dye, the binder was employed at 0.29 g/m$^2$, and each particulate material was present in the amounts indicated in Table 2.

A dye-receiving element was prepared by coating the following layers in the order recited on a titanium dioxide-pigmented polyethylene-overcoated paper stock which was subbed with a layer of poly(acrylonitrile-co-vinylidene chloride-co-acrylic acid) (14:79:7 wt. ratio) (0.08 g/m$^2$) coated from 2-butanone:

(1) Dye-receiving layer of Makrolon 5705 ® (Bayer AG Corporation) polycarbonate resin (2.9 g/m$^2$), Tone PCL-300 ® polycaprolactone (Union Carbide) (0.38 g/m$^2$), and 1,4-didecoxy-2,6-dimethoxyphenol (0.38 g/m$^2$) coated from methylene chloride; and (2) Overcoat layer of Tone PCL-300 ® polycaprolactone (Union Carbide) (0.11 g/m$^2$), FC-431 ® surfactant (3M Corp.) (0.01 g/m$^2$) and DC-510 ® Surfactant (Dow Corning) (0.01 g/m$^2$) coated from methylene chloride.

The dye-donor and dye-receiver were used for printing as in Example 1. Any low density ripple wave lines caused by wrinkles in the dye-donor by irregular passage through the thermal print head were observed. The following results were obtained:

TABLE 2

| Particles in Dye Layer at 0.02 g/m$^2$ | Donor | Wave Defects |
|---|---|---|
| None (control) | C | Yes |
| Control Compd. 6 (PE) | C | No |
| Control Compd. 7 (PE) | C | No |
| Compd. 3 (invention) | C | No |
| None (control) | Y | Yes |
| Control Compd. 1 (PTFE) | Y | No* |
| Control Compd. 8 (Castor oil) | Y | Yes |
| Control Compd. 9 (PEG) | Y | Yes |
| Control Compd. 10 (Paraffin) | Y | ** |

TABLE 2-continued

| Particles in Dye Layer at 0.05 g/m$^2$ | Donor | Wave Defects |
|---|---|---|
| None (control) | C | Yes |
| Control Compd. 6 (PE) | C | No |
| Control Compd. 7 (PE) | C | No |
| Compd. 3 (invention) | C | No |
| None (control) | Y | Yes |
| Control Compd. 1 (PTFE) | Y | Yes* |
| Control Compd. 8 (Castor oil) | Y | No |
| Control Compd. 9 (PEG) | Y | Yes |
| Control Compd. 10 (Paraffin) | Y | ** |

*Results were variable due to difficulties in avoiding agglomeration of particles prior to coating.

**This material caused severe dye crystallization in the dye-donor upon keeping at 60° C. for 70 hours, making uniform printing difficult. In areas of the donor where dye crystallization occurred, image discrimination was lost in low density areas and there was a decrease in maximum density on the print.

Control Compound 8

Castor oil.

Control Compound 9

Polyethylene glycol of m.w. 1300-1600

Control Compound 10

Paraffin wax.

The above results indicate that use of a particulate polyethylene or polypropylene wax generally gave images without any wave defects in comparison to the particulate materials of the prior art which gave wave defects. However, there are other problems with the use of polyethylene wax, as will be shown by Example 4.

EXAMPLE 3—SEPARATION DEFECTS

Cyan and yellow dye-donors were prepared as in Example 2.

A dye-receiving element was prepared by coating the following layer on a titanium dioxide-pigmented polyethylene-overcoated paper stock which was subbed with a layer of poly(acrylonitrile-co-vinylidene chloride-co-acrylic acid) (14:79:7 wt. ratio) (0.08 g/m$^2$) coated from 2-butanone;

Dye-receiving layer of Makrolon 5705 ® (Bayer AG Corporation) polycarbonate resin (2.9 g/m$^2$) and 1,4-didecoxy-2,6-dimethoxyphenol (0.38 g/m$^2$) coated from methylene chloride.

The dye-donors and dye receiver were used for printing as described in Example 1. The relative ease of release of the dye-receiver from the dye-donor after multiple printing of the dye-donor onto the same area of the dye-receiver was evaluated. Dye-receiver separation from the dye-donor was classified as follows:

E-Clean and easy separation of the donor and receiver even after multiple printing up to 6 times.

M-Some areas of the dye layer stuck to the receiver after 2 or 3 printings. Moderate effort to separate donor and receiver.

P-Dye layer stuck to the receiver extensively even after a single printing. Increased effort to separate donor and receiver. The following results were obtained:

TABLE 3

| Particles in Dye Layer |
|---|

TABLE 3-continued

| at 0.02 g/m² | Donor | Separation |
|---|---|---|
| None (control) | C | M |
| Control Compd. 6 (PE) | C | M |
| Control Compd. 7 (PE) | C | M—P |
| Compd. 3 (invention) | C | E |
| None (control) | Y | M |
| Control Compd. 1 (PTFE) | Y | P* |
| Control Compd. 8 (Castor oil) | Y | M |
| Control Compd. 9 (PEG) | Y | M |
| Control Compd. 10 (Paraffin) | Y | M** |
| **Particles in Dye Layer at 0.05 g/m²** | **Donor** | **Separation** |
| None (control) | C | M |
| Control Compd. 6 (PE) | C | M—E |
| Control Compd. 7 (PE) | C | M—E |
| Compd. 3 (invention) | C | E |
| None (control) | Y | M |
| Control Compd. 1 (PTFE) | Y | E* |
| Control Compd. 8 (Castor oil) | Y | P |
| Control Compd. 9 (PEG) | Y | P |
| Control Compd. 10 (Paraffin) | Y | E** |

*Results were variable due to difficulties in avoiding agglomeration of particles prior to coating.

**This material caused severe dye crystallization in the dye-donor upon keeping at 60° C. for 70 hours, making uniform printing difficult. In areas of the donor where dye crystallization occurred, image discrimination was lost in low density areas and there was a decrease in maximum density on the print.

The above results indicate that use of a particulate polypropylene wax gave clean separation of the dye-donor from the dye-receiver in comparison to several particulate materials of the prior art which had poor separation. While use of some of the prior art materials gave clean separation, they exhibited other undesirable characteristics as shown in Examples 2 and 4.

EXAMPLE 4—GLOSS COMPARISONS

A dye-receiving element was prepared as in Example 2.

Cyan dye-donors were prepared as in Example 1 except that they contained the particulate materials in the amounts indicated in Table 4. The dye-donors and dye-receivers were used for printing in the manner described in Example 1 except that a uniform maximum density cyan image was generated at 255 pulses/dot at an applied voltage of 24.5 volts.

The dye-receiving element was separated from the dye-donor and the surface gloss (as specular reflectance at a given angle) was evaluated using a Pacific Scientific (Gardner Laboratory Inc.) Multi-Angle Digital Glossgard Glossmeter, Series 30177. The higher relative gloss values represent higher gloss in the print which is desirable. The following results were obtained:

TABLE 4

| Particles in Dye Layer at 0.032 g/m² | Relative Gloss At 20° | Relative Gloss At 60° |
|---|---|---|
| None (control) | 25 | 73 |
| Control Compd. 6 (PE) | 18 | 59 |
| Control Compd. 7 (PE) | 29 | 68 |
| Compd. 3 (invention) | 43 | 80 |
| **Particles in Dye Layer at 0.048 g/m²** | **Relative Gloss At 20°** | **Relative Gloss At 60°** |
| None (control) | 25 | 73 |
| Control Compd. 6 (PE) | 19 | 60 |
| Control Compd. 7 (PE) | 18 | 59 |
| Compd. 3 (invention) | 35 | 74 |
| **Particles in Dye Layer at 0.081 g/m²** | **Relative Gloss At 20°** | **Relative Gloss At 60°** |
| None (control) | 25 | 73 |
| Control Compd. 6 (PE) | 14 | 50 |

TABLE 4-continued

| | | |
|---|---|---|
| Control Compd. 7 (PE) | 11 | 43 |
| Compd. 3 (invention) | 21 | 66 |

The above results indicate that the dye-donors containing polypropylene wax according to the invention gave higher relative specular reflectance than did dye-donors containing polyethylene wax of the prior art.

The invention has been described in detail with particular reference to preferred embodiments thereof, but it will be understood that variations and modifications can be effected within the spirit and scope of the invention.

What is claimed is:

1. In a dye-donor element for thermal dye transfer comprising a support having thereon a dye layer comprising sublimable a dye dispersed in a polymeric binder, the improvement wherein said dye layer also contains at least one particulate polypropylene wax having an average particle size less than about 30μm and having a melting point above about 125° C.

2. The element of claim 1 wherein said polymeric binder is a cellulosic ester.

3. The element of claim 2 wherein said cellulosic ester is cellulose acetate butyrate or cellulose acetate propionate.

4. The element of claim 1 wherein said particulate wax is present in an amount of from about 0.005 to about 0.2 g/m².

5. The element of claim 1 wherein said polypropylene wax has a melting point of about 140°-155° C.

6. The element of claim 1 wherein said support comprises poly(ethylene terephthalate) and the side of the support opposite the side having thereon said dye layer is coated with a slipping layer comprising a lubricating material.

7. The element of claim 1 wherein said dye layer comprises a sequential repeating areas of yellow, cyan and magenta dye.

8. In a process of forming a dye transfer image comprising (a) imagewise-heating a dye-donor element comprising a support having thereon a dye layer comprising sublimeable a dye dispersed in a polymeric binder, and (b) transferring a dye image to a dye-receiving element to form said dye transfer image.

the improvement wherein said dye layer also contains at least one particulate polypropylene wax having an average particle size less than about 30μm and having a melting point above about 125° C.

9. The process of claim 8 wherein said polymeric binder of said dye-donor element is a cellulosic ester.

10. The process of claim 9 wherein said cellulosic ester is cellulose acetate butyrate or cellulose acetate propionate.

11. The process of claim 8 wherein said particulate wax is present in an amount of from about 0.005 to about 0.2 g/m².

12. The process of claim 8 wherein said polypropylene wax has a melting point of about 140°-155° C.

13. The process of claim 8 wherein said support is poly(ethylene terephthalate) which is coated with sequential repeating areas of cyan, magenta and yellow dye, and said process steps are sequentially performed for each color to obtain a three-color dye transfer image.

14. In a thermal dye transfer assemblage comprising:

(a) a dye-donor element comprising a support having thereon a dye layer comprising sublimable a dye dispersed in a polymeric binder, and (b) a dye-receiving element comprising a support having thereon a dye image-receiving layer, said dye-receiving element being in a superposed relationship with said dye-donor element so that said dye layer is in contact with said dye image-receiving layer, the improvement wherein said dye layer also contains at least one particulate polypropylene wax having an average particle size less than about 30μm and having a melting point above about 125° C.

15. The assemblage of claim 14 wherein said polymeric binder is a cellulosic ester.

16. The assemblage of claim 15 wherein said cellulosic ester is cellulose acetate butyrate or cellulose acetate propionate.

17. The assemblage of claim 14 wherein said particulate wax is present in an amount of from about 0.005 to about 0.2 $g/m^2$.

18. The assemblage of claim 14 wherein said polypropylene wax has a melting point of about 140°-155° C.

* * * * *